United States Patent [19]

White

[11] Patent Number: 4,640,424

[45] Date of Patent: Feb. 3, 1987

[54] SELF-OPENING NIPPLE CONSTRUCTION AND NURSING CONTAINER

[75] Inventor: Leonard A. White, Gurnee, Ill.

[73] Assignee: Baxter Travenol Laboratories, Inc., Deerfield, Ill.

[21] Appl. No.: 840,523

[22] Filed: Mar. 13, 1986

Related U.S. Application Data

[63] Continuation of Ser. No. 599,305, Apr. 12, 1984, abandoned.

[51] Int. Cl.[4] ..... A61J 9/00; A61J 9/08; A61J 11/00; B65D 85/172

[52] U.S. Cl. ..... 215/11 R; 215/11 C; 206/603; 222/490; 222/541; 426/115; 426/117

[58] Field of Search ..... 215/11 R–11 E; 206/222, 532, 603; 426/115, 117; 220/277; 222/490, 541

[56] References Cited

U.S. PATENT DOCUMENTS

| | | | |
|---|---|---|---|
| 2,487,236 | 11/1949 | Greenberg | 206/222 X |
| 2,493,380 | 1/1950 | Bailey | 215/11 C |
| 2,616,581 | 11/1952 | Madsen et al. | 215/11 B |
| 3,138,278 | 6/1964 | Butts | 215/11 R |
| 3,146,904 | 9/1964 | Hansen et al. | 215/11 R |
| 3,187,918 | 6/1965 | Moore | 215/11 C |
| 3,220,588 | 11/1965 | Lipari | 206/222 |
| 3,266,910 | 8/1966 | Barnby | 215/11 R |
| 3,334,764 | 8/1967 | Fouser | 215/11 R |
| 3,439,824 | 4/1969 | Merrill, Jr. et al. | 215/11 C |
| 3,519,157 | 7/1970 | Meierhoefer | 215/11 C |
| 3,635,724 | 1/1972 | Schaar | 215/11 C X |
| 3,687,076 | 8/1972 | Friant et al. | 206/222 X |
| 3,747,791 | 7/1973 | Fouser | 215/11 C X |
| 3,779,413 | 12/1973 | Pickerell et al. | 215/11 C |
| 3,838,784 | 10/1974 | Barton et al. | 215/11 C |
| 3,952,897 | 4/1976 | Pickerell et al. | 215/11 C |
| 4,247,001 | 1/1981 | Wiegner | 215/DIG. 8 X |
| 4,412,623 | 11/1983 | Schmidt | 215/11 C X |

FOREIGN PATENT DOCUMENTS

| | | | |
|---|---|---|---|
| 909723 | 9/1973 | Canada | 206/222 |
| 1323928 | 7/1973 | United Kingdom | 215/11 C |
| 1335381 | 10/1973 | United Kingdom | 215/11 C |

*Primary Examiner*—William Price
*Assistant Examiner*—Sue A. Weaver
*Attorney, Agent, or Firm*—Paul C. Flattery; John P. Kirby, Jr.; John J. Ryberg

[57] ABSTRACT

A nipple assembly is disclosed for attachment to sealed nursing containers which includes accessing means for accessing the container contents by manipulating the nipple assembly. In one embodiment, the accessing means is disposed within a flexible nipple and is movable to pierce the container wall upon lateral compression or squeezing of the nipple. Other embodiments access the container contents by axially compressing or rotating the nipple assembly. Protective covers for the nipple assemblies are disclosed which cooperate to permit the particular manual manipulation needed to access the contents without direct human contact with the nipple surface. Also shown are particular features of a flexible container to which the nipple assemblies may be attached.

15 Claims, 24 Drawing Figures

SELF-OPENING NIPPLE CONSTRUCTION AND NURSING CONTAINER

This application is a continuation of application Ser. No. 599,305, filed Apr. 12, 1984, now abandoned.

The present invention relates, in general, to infant nursing containers and nipple assemblies associated therewith. More particularly, the present invention relates to sealed infant containers and nipple assemblies operable to provide access to the contents thereof.

Nursing containers for feeding liquids, such as water or nutritional formula, to an infant, have heretofore been known in a wide variety of shapes and configurations. Perhaps the best known infant nurser comprises a glass or plastic container which is closed by a nipple and threaded ring assembly.

While these nursers are best known for inhome applications, where they are prepared as needed, they have also been provided in a disposable prefilled and presterilized form, with nipple already attached. As depicted in U.S Pat. Nos. 3,586,196, and 3,838,784 to Barton et al., such containers typically include a glass container, sealed at the top with a weakened aluminum cap. A pre-attached nipple assembly including a rigid plastic threaded ring and a typical rubber or elastomeric nipple is then threadedly attached to the glass container, in a partially screwed-down position. The ring has a rigid depending projection for breaking through the aluminum cap upon further rotation of the ring. Although widely used, this general type of rigid nursing container has several drawbacks arising from the need to allow displacement air to enter the container as the liquid is dispensed. The nipple construction which allows displacement air to enter the container will sometimes malfunction, either leaking the container contents from the periphery of the nipple or preventing dispensing of the contents. In addition, the presence of large amounts of displacement air in the container increases the risk of infant ingestion of air.

More recently, as shown for example in U.S. Pat. Nos. 3,871,542 to Hammer and 3,790,017 to Fitzpatrick et al., nursing containers have been known comprising a generally cylindrical reusable holder, in which a replaceable, flexible liner may be secured by stretching the open liner over the end of the holder. Liquid is then poured into the liner, and an elastomeric nipple secured over the open end holding the liner in place. The collapsible liner has the advantage of not requiring displacement air for emptying of the contents and thus presenting less opportunity for an infant to ingest air from the container when it was empty of liquid, or when it is in a position where liquid is not at the nipple site. While having certain advantages over the rigid bottle nursers, the replaceable liner nursers, because they are not sterile, must be provided substantially on an as-needed basis and entail a series of cumbersome preparation steps which are not well suited to hospital, clinic or other institutional uses.

Thus it is the general object of the present invention to provide an improved nipple assembly and nursing container which does not suffer from the shortcomings described above.

It is a further object of the present invention to provide a self-opening nipple assembly particularly suitable for use with flexible plastic containers.

It is still a further object of the present invention to provide a self-opening nipple assembly which is relatively inexpensive to manufacture.

It is yet a further object of the present invention to provide a nipple-assembly particularly suited for large volume packaging.

These objects are achieved in accordance with the present invention in a disposable infant nurser of the type having a flexible wall portion operable to collapse upon withdrawal of liquid therefrom, whereby replacement air is not required for dispensing liquid to an infant. In accordance with the present invention, the container may be provided in a pre-filled, pre-sterilized form with a self-opening nipple assembly attached to the container wall to directly access the contents as needed. The nipple assembly of the present invention generally includes a hollow flexible dispensing nipple and accesssing means associated with said nipple and axially movable to penetrate the container wall portion to permit a dispensing of the liquid through the nipple.

In one embodiment of the present invention, the means for accessing the container contents is disposed at least in part within the flexible nipple, and is axially movable upon compression of the nipple to engage and rupture the container wall to provide access to the contents. Compression of the nipple may be achieved either directly, or indirectly by compressing a cover disposed over the nipple, thereby permitting access to the container contents without requiring human contact with the surface of the nipple. Depending on the particular construction of the accessing means, the flexible nipple may have a tapered side wall cooperative with the accessing means, so that lateral compression of the flexible nipple will result in axial movement of the accessing means to the accessing position. Alternatively, the accessing means may be disposed within the flexible nipple portion, so that axial compression of the flexible nipple portion results in axial movement of the accessing means. In these embodiments, the covers for the flexible nipple are also preferably compressible in the direction which will result in movement of the accessing means so that the contents may be accessed without requiring human contact with the surface of the nipple.

In accordance with yet a further embodiment of the present invention, the nipple assembly comprises a rigid mounting base with an upstanding hollow cylindrical portion or guide tube adapted for attachment to the container. The accessing means comprises a rigid hollow puncture member disposed for axial movement within the guide tube between a retracted position and an extended position to access the contents of the container. A flexible nipple is carried by the accessing means and communicates with the hollow puncture member, so that the contents may be dispensed to an infant through the nipple. In this embodiment, the accessing means may also include an annular sleeve around the puncturing member, which engages the upstanding guide tube to retain the puncturing member in either the retracted or extended position. This may be achieved either by means providing a detent between the accessing means and the upstanding guide tube, or the sleeve may be threadedly secured to the upstanding guide tube so that the puncturing member is moved to the accessing position by rotating the sleeve. In the latter arrangement, a freely rotatable cover is preferably disposed over the nipple. An interference fit between the cover and the sleeve, such as engaging spline, permit the sleeve to be rotated by rotating the outer cover, thereby again permitting the contents of the container to be accessed without requiring tactile contact with the dispensing nipple.

These and various other features and objects of the present invention are set forth fully in the following detailed description of the attached drawings, of which:

The following summary of the drawings is intended to acquaint the reader with various aspects of the present invention which will make the subsequent more detailed description easier to read and understand.

Figure 1:
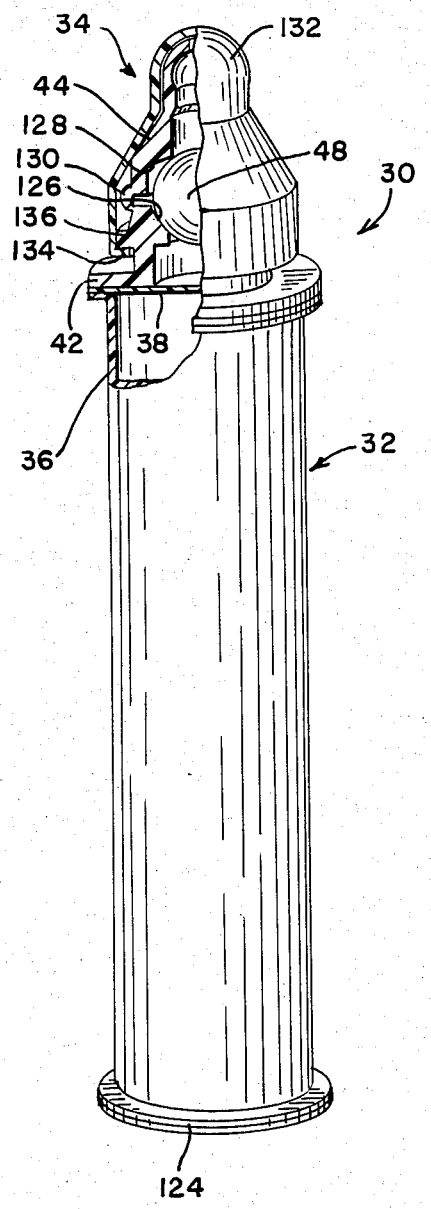
FIG. 1 is a perspective view, partially broken away, of a nursing container and nipple assembly embodying the present invention.
Figure 2:
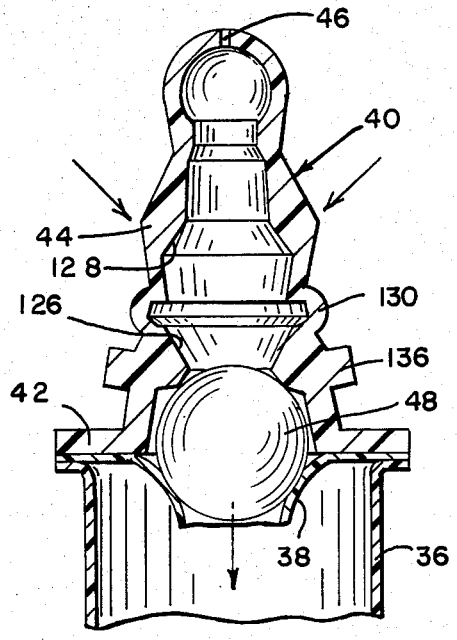
FIG. 2 is a partial sectional view of the container and nipple assembly of FIG. 1, depicting accessing of the container contents by lateral compression of the nipple.

Referring to FIGS. 1 and 2, the present invention is generally embodied in an infant nurser 30 having a container portion 32 and nipple assembly 34 attached to the container. In accordance with the present invention, the container 32 is defined by a flexible wall 36 which is progressively collapsible as the contents of the container are emptied through the nipple assembly. The nipple assembly 34 is sealingly attached to the container adjacent a penetrable portion 38 of the container wall. The nipple assembly 34 itself includes a nipple 40 having a base portion 42 attached to the container, and an upstanding flexible nipple 44 terminating in a dispensing aperture 46. In accordance with the present invention, accessing means, depicted as a spherical member 48 in FIGS. 1 and 2, is disposed within the hollow flexible nipple 40 and movable axially upon compression of the nipple to penetrate the frangible container wall 38, as shown in FIG. 2, and permit dispensing of the container contents through the nipple.

Figure 3:
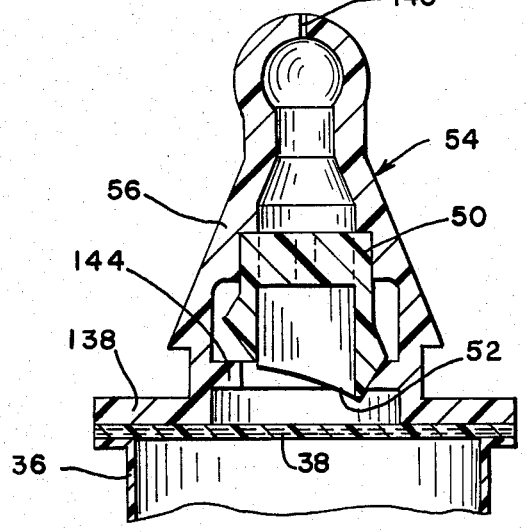
FIG. 3 is a partial sectional view of a container and nipple assembly embodying the present invention, employing an alternative accessing means for accessing the contents of the container.
Figure 5:
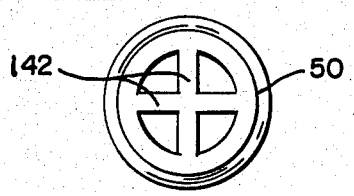
FIG. 5 is a top view of the accessing means of FIG. 4 taken along line 5—5 of FIG. 4.
Figure 4:
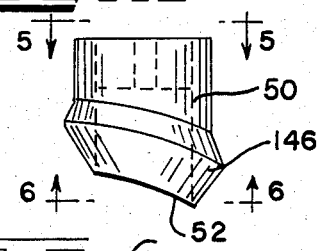
FIG. 4 is an elevational view of the accessing means of the type employed in FIG. 3.
Figure 6:
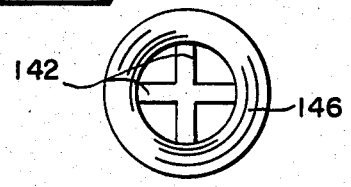
FIG. 6 is a bottom view of the accessing means of FIG. 4, taken along line 6—6 of FIG. 4.

Alternative accessing means and associated nipple constructions are depicted in FIGS. 3–15. In FIG. 3, accessing means is a generally hollow cylindrical member 50, with a lower cutting edge 52 disposed to penetrate the penetrable wall portion 38 upon lateral compression of the flexible nipple portion. The flexible nipple 54 associated with that nipple assembly has a generally tapered side wall 56 which cooperates in lateral compression of the nipple to force axial movement of the hollow cylindrical member 50.

Figure 11:
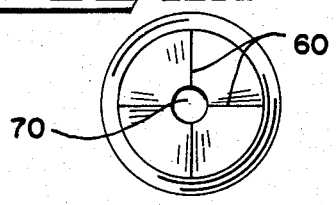
FIG. 11 is a bottom view of the accessing means of FIG. 9 taken along line 11—11 of FIG. 9.
Figure 12:
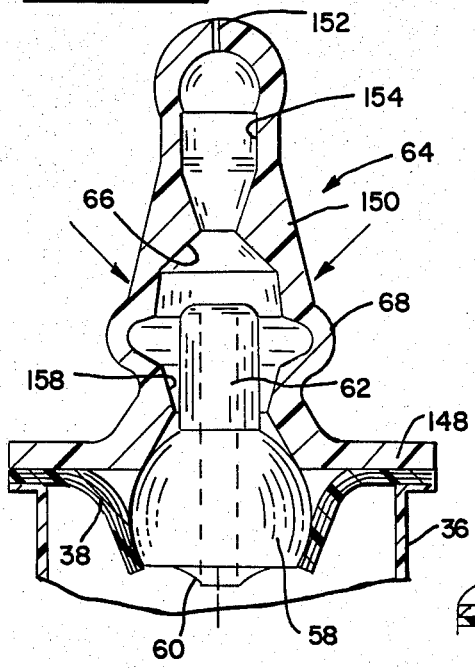
FIG. 12 is a partial sectional view of the nipple assembly and container of FIG. 8, depicting lateral compression of the nipple which causes axial movement of the accessing means to open the container.

In the embodiments depicted in FIGS. 8–12, the accessing means comprises a spherical member 58 with a lower cutting edge 60 and an upstanding stabilizing member 62 tightly engaged by the side wall of the flexible nipple 64. The nipple 64 has an internal annular tapered side wall 66 disposed to engage the spherical portion 58 upon compression, and an annular bellows portion 68 disposed outwardly of the spherical member which cooperate in lateral compression of the nipple to force the spherical member through the penetrable container wall, as depicted in FIG. 12. A center passageway 70 through the cylindrical member and stabilizing member provides communication between the container contents and the dispensing end of the nipple.

Figure 13:
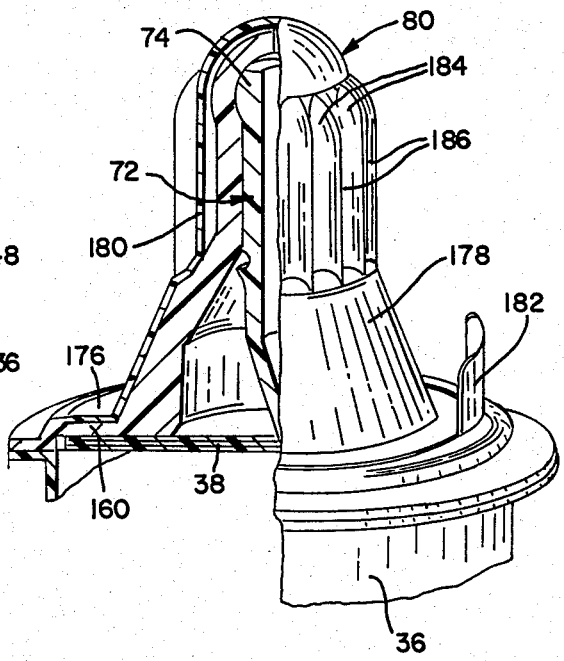
FIG. 13 is a perspective view, partially in section, of a nipple assembly and container embodying the present invention, and including a protective cover over the nipple.
Figure 14:
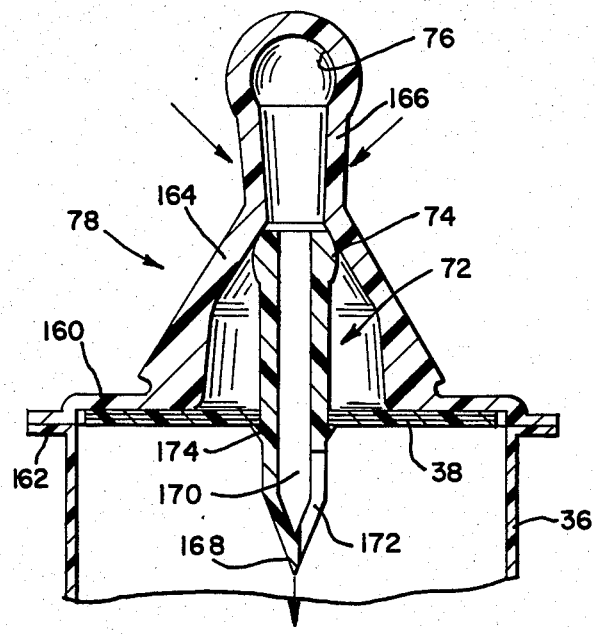
FIG. 14 is a partial sectional view of the nipple assembly and container of FIG. 13, with cover removed and depicting lateral compression of the nipple to force the accessing means in an axial direction to access the container contents.
Figure 15:
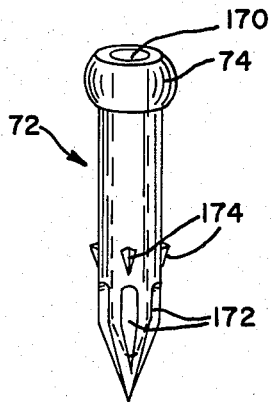
FIG. 15 is a perspective view of the accessing means, employed in FIGS. 13 and 14.

In FIGS. 13–15, the accessing means is an elongated hollow spike 72 having a generally spherical upper end portion 74 normally located, when in the retracted position, within a spherical end portion 76 of the flexible nipple 78, whereby a squeezing of the end of the nipple will force the spike downwardly, through the penetrable portion 38 of the container wall.

In any of the four described embodiments, a cover 80 (FIG. 13) may be provided to enclose and protect the nipple. When employed in connection with the above described embodiments, which utilize lateral compression for axial movement of the accessing means, the cover 80 is preferably substantially rigid in the axial direction, to resist crushing during shipment or stacking, but compressible laterally, to permit manual opening of the container without direct human contact with the surface of the nipple.

Figure 16:
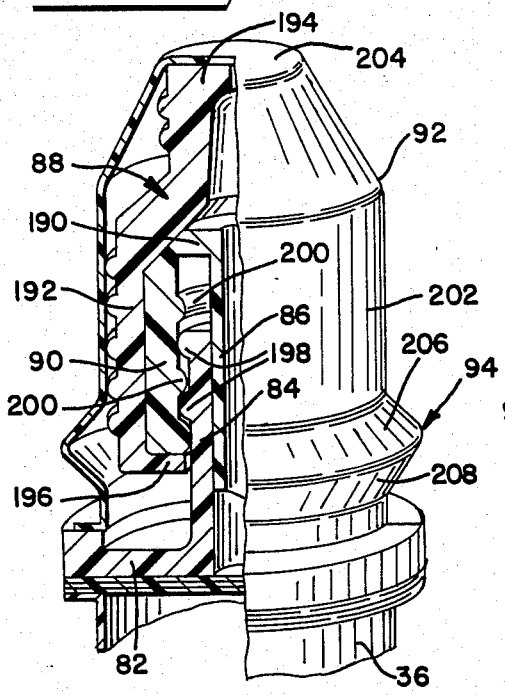
FIG. 16 is a perspective view, partially broken away of an alternative embodiment of a nipple assembly and container embodying the present invention, and including a cover over the nipple assembly.
Figure 17:
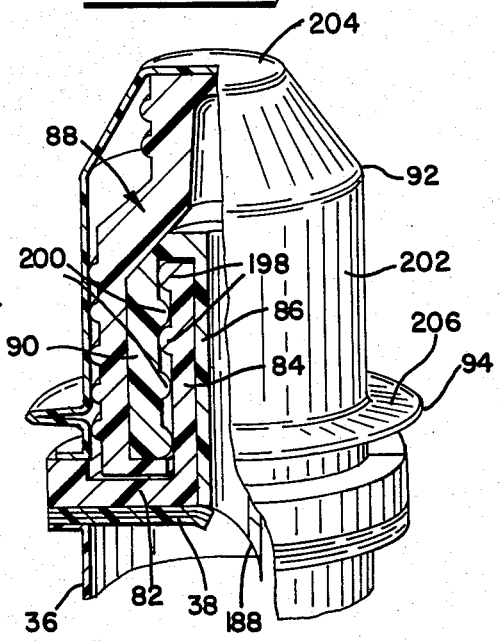
FIG. 17 is a perspective view, of the container and nipple assembly of FIG. 16, depicting the nipple assembly with the accessing means is an extended position, penetrating the container to provide access to the contents thereof.

Further alternative embodiments of the present invention are depicted in FIGS. 16–19. In those nipple assembly structures, the nipple assembly has a separate base flange 82 with an upstanding hollow cylindrical member or guide tube 84, and the accessing means for opening the container includes an elongated hollow puncture member 86 positioned for axial movement within the hollow cylindrical member 84 between a retracted position, as shown in FIG. 16, and an extended position, as shown in FIG. 17, for breaching the penetrable portion 38 of the container wall to access the container contents.

In the embodiments depicted in FIG. 16 and 17, a dispensing nipple 88 is carried on an outer sleeve 90 of said accessing means for dispensing the contents when the container is breached, and a cover 92 may be provided which has an annular fold 94 that permits axial compression of the cover to force the accessing means to the accessing position (FIG. 17) without human contact with the surface of the nipple 88.

Figure 18:
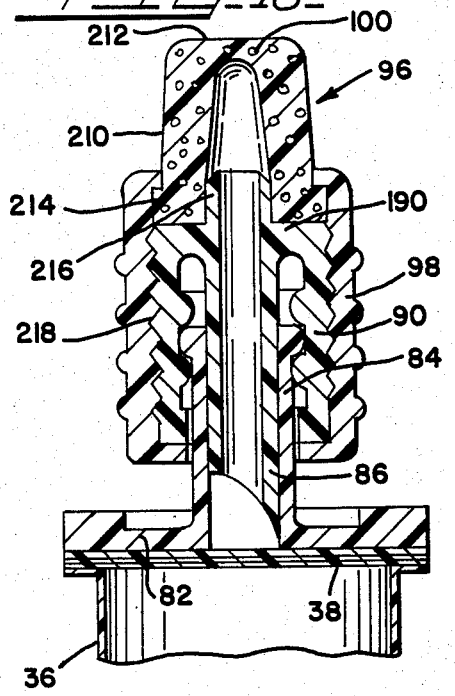
FIG. 18 is a partial sectional view of a nipple assembly and container embodying the present invention and employing a foam nipple.
Figure 19:
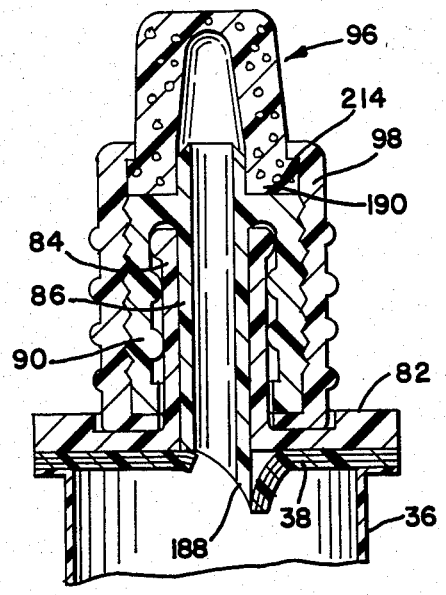
FIG. 19 is a partial sectional view of the nipple assembly and container of FIG. 18, depicting the nipple assembly with the accessing means in an extended position to provide access to the contents of the container.

A similar structure is depicted in FIGS. 18–19, but therein the nipple 96 is secured to the puncturing member by a locking ring 98. The nipple 96 of FIGS. 18 and 19 is preferably made of an elastomeric foam, and has different densities in different portions of the nipple. For example, in the dispensing end 100 of the nipple, the foam is sufficient porous to permit the passage of liquid therethrough. The lower edge portion of the nipple, however, which is captured by the locking ring 98, is sufficiently dense to prevent liquid passage therethrough.

Still further alternative embodiments of the present invention are depicted in FIGS. 20–24. In the embodiments depicted in FIGS. 20–24, the nursing container has a generally flexible side wall 102 which is sealed together at one end and bonded to a threaded fitment 104 at the other end. The fitment has a center passageway 106 normally closed by diaphragm 108. The accessing means comprises a generally hollow puncturing member 110 disposed for axial movement within the passageway 106 between a retracted position shown in FIG. 22 and an extended position, shown in FIG. 23, piercing a diaphragm 108 to permit dispensing of the container contents through nipple 112 or 234 carried on the opposite end of the puncturing member. For axial movement of the puncturing member, the accessing means includes an annular sleeve 114 which is internally threaded to engage the threaded fitment such that rotation of the sleeve results in axial movement of the puncturing member 110.

Figure 20:
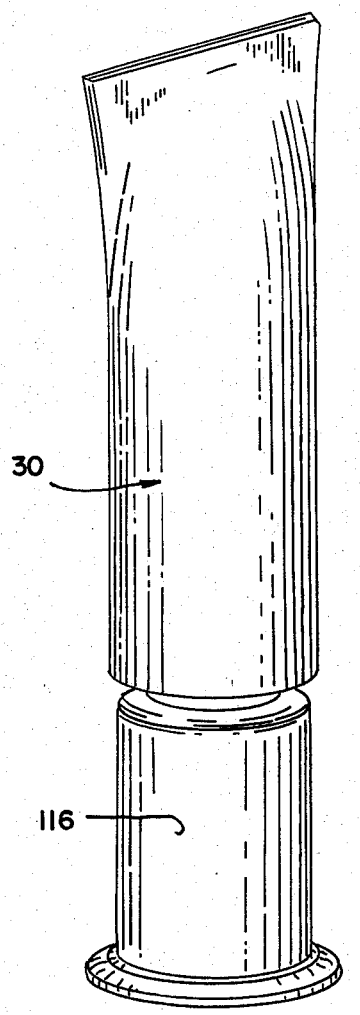
FIG. 20 is a perspective view of a container and closure embodying yet a further an alternative construction of the present invention.
Figure 21:
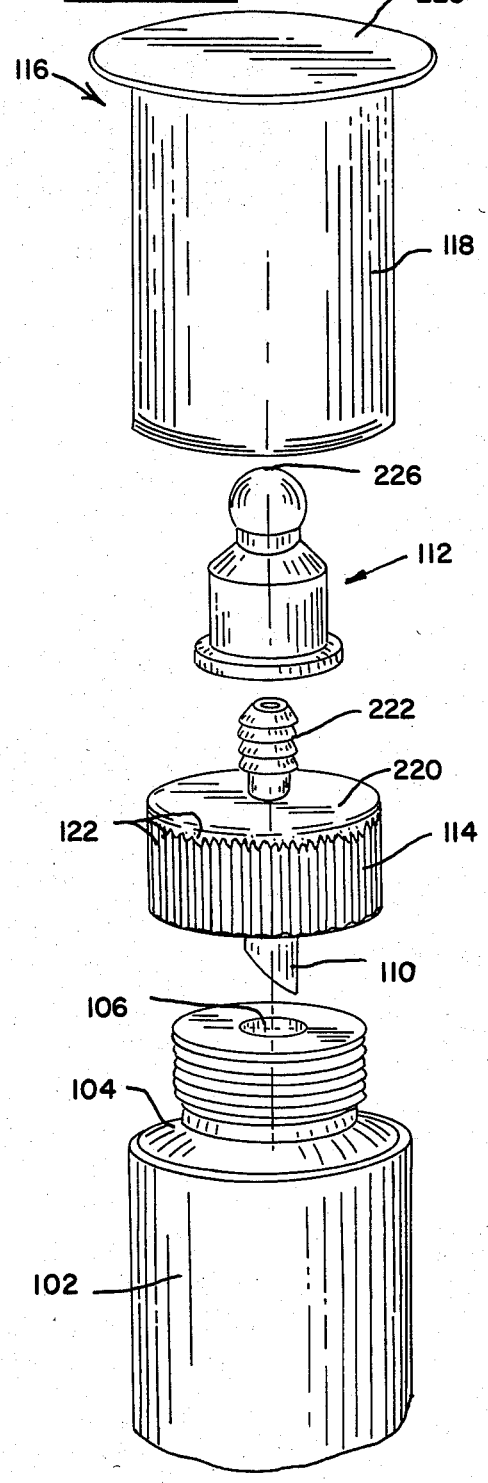
FIG. 21 is an exploded perspective view of the component parts of the container and nipple assembly of FIG. 20.

A cover 116 may also be used in association with this embodiment of the present invention for protecting the nipple 112 until the contents of a container are to be dispensed. The cover 116 depicted in FIGS. 20–23, has a generally cylindrical side wall 118 closed at the top, and including a plurality of inwardly directed gripping fingers 120 at the bottom for holding said cover to the fitment in a freely rotating manner. Interengaging spline 122 between the sleeve 114 and side wall 118 prevent relative rotation of the cover with respect to the sleeve, so that rotation of the cover also causes rotation of the sleeve and axial movement of the puncturing member to the accessing position shown in FIG. 23. Thus, as in the earlier embodiments, the contents of the container may be accessed without tactile contact with the nipple itself. In each of the embodiments depicted in FIGS. 22 and 24, means may be provided internally of the cover for capturing the dispensing end of the nipple in a sealed compartment within said cover. The top portion of the cover is also preferably flat, so that the container may be stood on end, as depicted in FIG. 20, for shipping and/or storage.

Turning now to a more detailed description of the preferred and alternative embodiments depicted in the attached drawings, FIG. 1 depicts the infant nurser 30, of the present invention, in its entirety. The container portion 32 is shown, for purposes of illustration, as having a flexible cylindrical side wall 36, a flat bottom wall 124 and a flat penetrable top wall 38 sealingly secured to the cylindrical side wall. The particular shape, however, of the container may be readily varied. For example, the container may be in the form of a plastic pouch or other suitable configuration, wherein the flexible walls of the container will collapse as fluid is dispensed therefrom. As noted earlier, this has the advantage of permitting dispensing of the contents without the necessity of displacement air entering the container, which results in less risk of air ingestion by the infant. In the embodiments shown in FIGS. 1 and 2, the container wall 36 and penetrable portion 38 are also shown as comprising a single plastic layer. While a single layer of polyethelene, polypropylene, or other material may be suitable in some applications, in other applications, where oxygen or ultraviolet ray transmission through the container wall is a concern, the container may be of multiple layer plastic construction, in which one of the layers comprises an oxygen barrier such as Saran plastic or a barrier to ultraviolet light, without departing from the present invention.

The nipple 40 of the assembly depicted in FIGS. 1 and 2 is preferably made of resilient elastomeric plastic such as Kraton G thermoplastic elastomer or other plastic material suitable for thermal bonding to the container wall. Other materials may also be used if the nipple is secured to container by other available techniques, such as adhesive or solvent bonding. The nipple itself is generally hollow, and has internal and external surface configurations cooperative with the spherical member 48 to retain it normally in a retracted position, as depicted in FIG. 1, and for moving it to an extended position, as depicted in FIG. 2, for accessing the container contents. More particularly, the nipple has a generally flat radial base flange 42 which is sealed to the penetrable wall portion 38 of the container 32 by heat seal (sonic welding or the like), solvent seal or adhesive. Internally, the spherical member 48 is retained in the recessed position between a lower internal annular shoulder 126 and an upper internal annular shoulder 128.

Upon lateral compression or squeezing of the flexible nipple, the downwardly facing annular shoulder 128 forces the spherical member 48 downwardly, past the lower shoulder 126, which temporarily spreads apart to permit passage of the spherical member, and through the penetrable wall portion 38 of the container. The flexure of the nipple in forcing the spherical member downwardly is accomodated, in part, by an annular, U-shaped bellows portion 130 in the nipple wall. The bellows portion is located substantially radially outwardly of the spherical member, and helps accomodate temporary enlargement of the shoulder 126 to permit passage of the spherical member 48. After breaching the frangible portion 38 of the container, the nipple is released and resumes its normal shape.

The spherical member 48 is preferably made of a rigid plastic, although it may be constructed of other sufficiently strong materials. To assure that the spherical member 48 does not block the nipple after the container is breached, it preferably has a specific gravity of less than 1.0, so that it will float to the surface of the liquid in the container when the container is inverted to feed an infant.

To protect and enclose the nipple 40, the nurser 30 also preferably has a rigid plastic cover 132 which encloses the nipple. To retain the cover over the nipple, the cover preferably has a radially inwardly directed bottom flange 134 for snap engagement beneath an external annular rib 136 on the nipple.

An alternative nipple assembly construction is depicted in FIGS. 3–7. As shown in FIG. 3, the generally one piece nipple 54 is sealingly secured to the top of the container 32. The penetrable wall of the container 38 in FIG. 3 is depicted for illustrative purposes as having more than one layer, for example one layer may be an oxygen barrier, such as Saran plastic or other material. As with the nipple depicted in FIGS. 1 and 2, the nipple 54 of FIG. 3 has a generally flat radially extending base flange 138, for sealed attachment to the container. The generally tapered side wall 56 extends upwardly from the flange and terminates in a dispensing aperture 140. The nipple is generally hollow, and made of preferably soft flexible elastomeric material as described above.

For accessing the contents of the container 32, the hollow cylindrical accessing member 50 is carried within the nipple. The accessing member is normally retained in a retracted position, as depicted in FIG. 3, by tight fitting engagement between the upper end of the accessing member and the internal side wall surface of the nipple. As shown more clearly in FIGS. 4–6, the hollow cylindrical accessing member 50 is preferably made of rigid plastic construction. Diametrical reinforcing ribs 142 at the upper end of the container reinforce the accessing member against deformation when the nipple is squeezed to access the container contents. The lower end of the accessing member is preferably tapered to define the cutting edge 52 for penetrating the penetrable portion 38 of the container.

Figure 7:
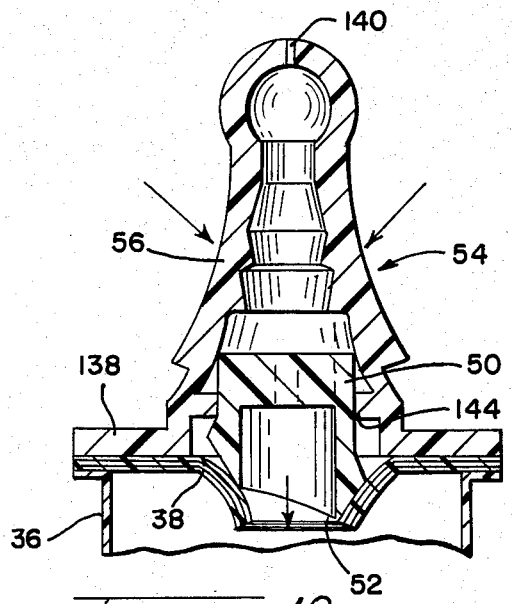
FIG. 7 is a view of the container and nipple assembly of FIG. 6, depicting lateral compression of the nipple to cause axial movement of the accessing means to open the container for dispensing of the contents through the nipple.
Figure 10:
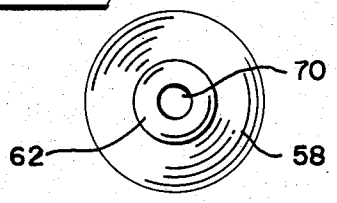
FIG. 10 is a top view of the accessing means of FIG. 9, taken along line 10—10 of FIG. 9.

As shown in FIG. 7, lateral compression of the side wall 56 of the nipple 54 forces the accessing member 50 downwardly, through the penetrable portion 38 of the container. To prevent inadvertent retraction of the accessing member, the nipple has an internal annular rib 144 which defines a passageway in the nipple, through which the accessing member must pass as it moves to the accessing position. The natural flexibility of the nipple permits temporary enlargement for passage of the cutting end of the accessing member through the passageway and past the rib. Abuttment between the rib and the thickened enlarged end portion 146 of the accessing member prevents inadvertant retraction of the accessing member into the retracted position. Because the accessing member is hollow, the contents of the container can flow through the accessing member and to the dispensing end of the nipple.

Figure 8:
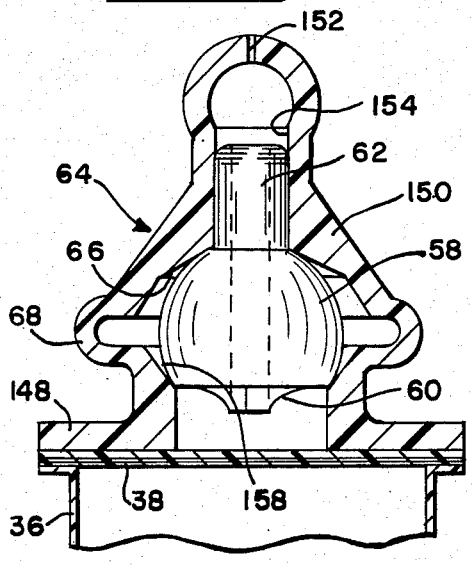
FIG. 8 is a partial sectional view of a nipple assembly and container embodying the present invention and employing alternative accessing means and nipple construction.

Another embodiment of the nipple assembly and container of this invention is presented in FIGS. 8–12. In FIG. 8, as in the other embodiments, the nipple assembly includes the flexible nipple 64 which has a generally flat radially extending flange 148 which is bonded to the container wall 38. The nipple includes a generally tapered outer side wall portion 150 which terminates in the dispensing aperture 152.

Figure 9:
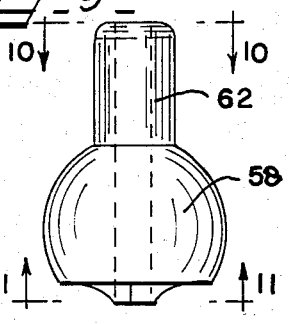
FIG. 9 is an elevational view of the accessing means employed in the nipple assembly of FIG. 8.

As noted earlier, the accessing member employed in the nipple assembly of FIG. 8, has a generally spherical portion 58 captured between an upwardly facing annular shoulder 158 and the downwardly facing internal shoulder 66 of the nipple when in the retracted position depicted in FIG. 8. The accessing member also has an upstanding generally cylindrical portion 62, in tight fitting engagement with a hollow cylindrical internal wall 154 of the nipple, adding stability to the hollow spherical portion and assuring that its lower cutting edge 60 is directed downwardly toward the penetrable portion 38 of the container. As best shown in FIGS. 9 and 11, the undersurface of the cylindrical member defines 4 radial extending cutting edges 60. The accessing member is moved to the extended position by lateral compression of the side walls of the nipple. The internal downwardly facing shoulder 66 contacts the spherical surface and forces the accessing member downwardly past the temporarily enlarged lower shoulder 158, and through the penetrable portion 38 of the container wall, as depicted in FIG. 12. The hollow center passageway 70 in the accessing member of FIG. 8 permits liquid flow from the container to the dispensing end of the nipple after opening.

Yet a further embodiment of a nipple assembly having an accessing element which is movable upon lateral compression of the nipple is depicted in FIGS. 13–15. FIGS. 13 and 14 show a nipple assembly employing the spike 72 as the accessing element disposed within nipple 78. The nipple assembly of FIGS. 13 and 14 is also somewhat different from the previous nipple assemblies in that the penetrable portion 38 is bonded solely to the underside of radial flange 160 of the nipple. A portion of the flange 160 extending beyond the frangible wall 38 is bonded to the container. This construction has the advantage of an outwardly extending shoulder 162 permitting the nipple assembly to be provided as a sealed integral unit for attachment to a suitable container. In this embodiment, the penetrable layer of plastic or other suitable material sealed to the underside of the bottom flange 160 is depicted as a multiple layer laminate, which may comprise a plastic oxygen barrier layer as well as layers of other plastics particularly suited for this application.

The upstanding flexible portion of the nipple 78 generally includes a tapered side wall portion 164 and a generally cylindrical portion 166 which terminates in the spherical dispensing end portion 76.

The dispensing spike 72 for accessing the container contents is shown in perspective in FIG. 15. The spike that generally comprises an elongated shaft which terminates at its upper end in the generally bulbous spherical portion 74 at its lower end in a puncturing point 168, for penetrating the penetrable plastic portion 38. The spike has a generally central passageway 170 extending the length thereof, between the spherical portion and peripherally located access ports 172 at the puncturing point. In the retracted position, as depicted in FIG. 13, the spike is generally contained within the flexible portion of the nipple, with the spherical portion 74 within the spherical dispensing end 76 of the nipple, and with the puncturing point located above the penetrable plastic layer 38. Upon compression of the spherical end portion of the nipple, the spike is forced downwardly, through the penetrable layer, to access the contents of the container. Discrete barbs 174 located on the spike shaft intermediate the puncturing end and the bulbous portion prevents inadvertant retraction of the spike from the dispensing position depicted in FIG. 14. When the spike 72 is forced to the liquid accessing position, the barbs catch beneath the penetrable portion and retains the spike in the liquid accessing position.

To preserve the sterility or cleanliness of the nipple assembly until use, the cover 80 (FIG. 13) may be sealed over the flexible nipple portion. As depicted in FIG. 13, the cover 80 is preferably of a semirigid plastic construction, with a generally flat radial base portion 176 bonded to the upper surface of nipple flange 160. The manner in which the cover is bonded to the flange may be selected from such as thermal bonding, solvent bonding, adhesive or the like. The cover has a generally tapered side wall 178 which conforms to the tapered side wall portion 164 of the nipple, and a generally axially extending portion 180 which encloses the dispensing end of the nipple. A pull tab 182 is located along the lower periphery of the cover to permit manual removal of the cover from the nipple flange to access the nipple.

The particular construction of the cover depicted in FIG. 13 also serves to permit manual movement of the accessing member 72 to the accessing position, without requiring contact with the surface of the nipple itself. For that purpose, the generally axially extending portion of the cover has a generally fluted shape, which is best seen in FIG. 13. The fluted shape is made up of a plurality of a generally concave or furrowed portions 184 alternating with vertically extending raised rib portions 186 therebetween. This side wall construction provides an essentially rigid structure in the vertical direction, while permitting lateral compression of the cover and the nipple assembly within, to force the accessing member 72 to the accessing position. In other words, the cover construction is compressible laterally to allow squeezing of the dispensing end of the nipple through the cover to force the accessing member 72 downwardly. The resistance to bending in the vertical direction permits stacking of the containers atop one another without fear of inadvertantly causing the accessing member to penetrate the sealed container.

FIGS. 16 and 17 depict an embodiment of the present invention which accesses container contents by vertical compression of the nipple assembly, instead of lateral compression as in the embodiment above. The nipple assembly of FIGS. 16 and 17 is secured to the container wall as in any of the suitable manners described above. Hollow guide tube or cylindrical member 84 upstanding from the center of the base portion, slidably receives the hollow puncturing member 86 which is employed to access the container contents. The puncture member 86 is preferably in the form of a hollow spike with a puncturing point 188 at the lower end and connected at its upper end, via top wall 190, to the annular sleeve or side wall 90. The sleeve is radially spaced from the spike, to slidably receive the guide tube 84 therebetween.

To dispense the contents of the container to an infant, the hollow flexible nipple 88 is carried by the sleeve 90. In the depicted embodiment, the nipple 88 has a generally cylindrical side wall 192 disposed over the sleeve 90, and a smaller dispensing end 194 which communicates directly with the base of the spike. The natural resilience of the nipple 88, and an inwardly directed bottom radial flange 196 holds the nipple tightly on the sleeve 90.

In the retracted position, depicted in FIG. 16, the puncturing end 188 of the spike is located within the guide tube above the penetrable wall portion. Abutment between radially outwardly extending ribs 198 on the upstanding guide tube and radially inwardly extending ribs 200 of the sleeve 90 provide a detent to hold the nipple assembly in the retracted position. Vertical force exerted downwardly on the nipple assembly, causes the abutting rings to snap past one another, and the end of the spike 188 to be forced through the penetrable wall portion, to access the contents of the container for dispensing through the nipple. Abutment between the radially extending rings 198 and 200 also provide a detent to prevent accidental retraction of the nipple assembly from the access position.

To preserve the sterility of the nipple assembly in FIGS. 16 and 17 until needed, the cover 92 may be sealed over the nipple assembly. In the depicted embodiment, the cover 92 is of semi-rigid plastic and is peelably sealed at its lower edge to the base flange 82. The cover may be heat sealed, solvent sealed, or other techniques may be used to hermetically seal the cover over the nipple assembly. In the depicted embodiment, the cover includes a generally upstanding side wall portion 202 which terminates in a flat top wall 204. An annular accordian fold or folds, generally at 94, is provided in the side wall of the cover to permit compression of the cover to access the container contents without requiring direct contact with the surface of the nipple 88. As depicted in FIG. 16, which shows the nipple assembly in the retracted position, the accordian fold comprises a pair of annular outwardly extending wall portion 206 and 208. To access the contents of the container, the top of the cover is forced axially downwardly. To accomodate the downward movement, the accordian fold collapses into a completely folded position, as depicted in FIG. 17. Although depicted as a single accordian fold, the fold may also be achieved by serveral fold lines, each having smaller wall portion 206 and 208.

An alternative embodiment of the nipple assembly depicted in FIGS. 16 and 17 is shown in FIGS. 18 and 19. The nipple assembly there, as in FIGS. 16 and 17, includes radial base flange 82 for sealing attachment to the end of the container 32 and a hollow upstanding guide tube 84. For accessing the contents of the container, a puncturing spike 86 is positioned for axial movement within the upstanding guide tube and attached to an annular sleeve 90.

The essential differences between the embodiment of FIGS. 18 and 19 and that of FIGS. 16 and 17 pertain to the construction of the dispensing nipple, and the means of attachment of the nipple to the puncturing spike 86. In the embodiments of FIGS. 18 and 19, the dispensing nipple 96 is of elastomeric foam construction. Preferably the nipple 96 is made of a elastomeric foam material having different densities in different areas of the nipple. For example, as depicted in FIG. 18, the nipple 96 has a generally cylindrical, slightly tapered side wall 210, a top wall 212 and a bottom radial flange 214. Employing a well known process, commonly referred to as differential molding, the nipple is formed such that the dispensing end 100 of the nipple at the upper portion of the side wall and the top wall is sufficiently porous to permit passage of liquid therethrough to a suckling infant. At least the radial flange portion and the lower end of the side wall are sufficiently dense to prevent liquid transfer therethrough. Accordingly, liquid passes only through a defined, localized dispensing area of the nipple. Preferably the elastomeric material of which the nipple is made is a thermoplastc elastomer or soft plastic material which is not reactive with infant formula or water, and has sufficient strength to resist biting or chewing by an infant.

The nipple 96 of the embodiment in FIGS. 18 and 19 is mounted atop a short extension 216 of the puncturing spike 86. The bottom flange 214 of the nipple is captured between an annular locking ring 98 and the top wall 190 of the spike. The annular ring 98 may be attached to the sleeve 90 in various ways, for example, solvent bonding, heat bonding, or the like. A mechanical attachment is, however, depicted in FIGS. 18 and 19. As shown therein, the outer surface of the sleeve 90 is serrated at 218 to engage matching serrations on the internal surface of the annular ring and to lock the ring to the annular sleeve.

FIG. 18, depicts the nipple assembly in a retracted position, with the piercing end of the spike 188 disposed within the hollow cylindrical guide tube 84, and FIG. 19 depicts the nipple assembly in the accessing position, with the spike 86 puncturing the penetrable portion 38 of the container wall. Of course, a cover, such as cover 92 shown in FIGS. 16 and 17 could also be used with the nipple assembly of FIGS. 18 and 19.

Other embodiments of the present invention wherein the accessing means is moved to an accessing position by rotation are depicted in FIGS. 20–24. FIG. 20 depicts the nursing container generally 30' with cover 116, standing in an inverted position, which is permitted by the flat end portion of the cover. The components of the container closure and cover are better seen in FIG. 21, 22 and 23. As shown therein, the container 30' is a generally thin wall plastic construction sealed at one end and attached to a rigid closure fitment 104 at the other end. The side walls 102 of the container are preferably of flexible plastic construction, and may be one layer, as depicted in the drawings, or multiple layers or laminated to provide an oxygen barrier, ultraviolet light barrier, or for other purposes. The closure fitment 104 is of rigid plastic material and bonded, as by heat bonding, solvent bonding, or the like to the side wall 102 of the container. The closure fitment 104 includes a generally upstanding cylindrical portion, which has a threaded side wall and a hollow cylindrical passageway 106 closed at the bottom by the diaphragm 108. The means for accessing the contents of the container comprise a generally one piece accessing member which has a planar top wall 220, a depending cylindrical side wall or sleeve 114 which is internally threaded for engagement with the threaded closure fitment and a hollow puncturing spike portion 110 depending from the center of said top wall for slidable movement within the cylindrical passageway 106 of the closure fitment. A short continuation of the spike above the top wall of the cap provides a stub 222 onto which the flexible nipple 112 is mounted. The nipple 112 is preferably of resilient elastomeric material, such as thermoplastic elastomer and has an internal passageway 224 extending through the nipple, to provide communication between the container contents and dispensing orifice 266 in the end of the nipple.

Although the nipple may be attached to the container accessing member (spike) in various ways, in the depicted embodiment, the nipple is frictionally secured to upstanding stubb 222, which has a serrated surface to hold the nipple in a fluid tight position thereon. The puncturing spike is movable between a retracted position, as shown in FIG. 22, wherein the puncturing end of the spike is disposed within the cylindrical passageway in the closure fitment above the diaphragm 108, and an extended position, as shown in FIG. 23, wherein the spike extends downwardly through the sealing membrane, to access the container contents.

The spike 110 is moved to the extended position by rotating the sleeve 114 downwardly on the fitment. This may be achieved directly by manual rotation of the sleeve itself, but in accordance with the preferred embodiment, the cover 116 may be provided in a manner which permits manual rotation of the accessing means without direct contact therewith. As shown in FIG. 22, the cover 116 includes a generally hollow cylindrical side wall portion 118 and a generally flat top wall 228. A plurality of radially inwardly directed gripping fingers 120 are formed at the lower end of the side wall, to extend into a matching groove 230 in the closure member. The fingers 120 thus hold the cover axially in place. The fingers 120 also provide a tamper indication in the event the container is opened prior to use. Significant movement of the cover 116 angularly or axially will cause one or more fingers 120 to snap-off. Thus, it will be clearly apparent when the container has been opened.

To cause rotation of the accessing spike 110, axially extending spline 122 are provided on the interior surface of the cover side wall for interlocking engagement with a spline 122 on the surface of sleeve 114 of the accessing means. When the cover is secured in place, the interlocking spline prevent rotation of the cover without also causing rotation of the accessing member. Thus, the accessing member may be moved from the retracted position to the extended position by manually rotating the cover so as to cause the sleeve 114 to screw down on the closure fitment 104 until the spike 110 punctures the sealing diaphragm 108.

Figure 22:
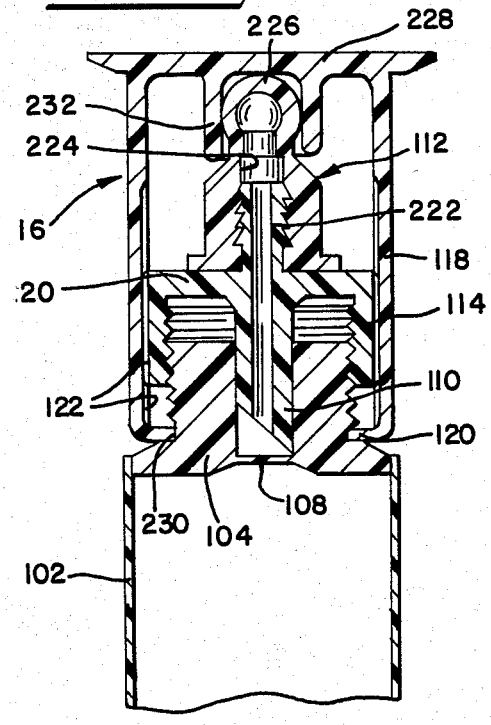
FIG. 22 is a sectional view of the assembled container and nipple assembly of FIG. 21 embodying, the present invention.
Figure 23:
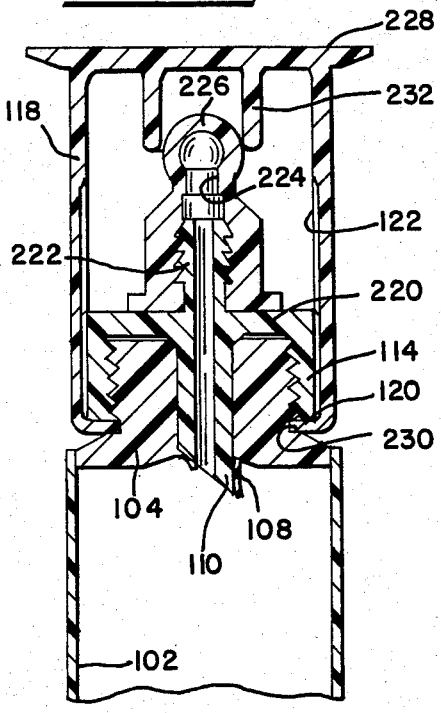
FIG. 23 is a partial sectional view of the container and nipple assembly of FIG. 22 with the accessing means in the extended position, wherein the contents of the container are accessed for dispensing through the nipple.

To provide additional protection to the dispensing end of the nipple assembly, the cover 116 includes a generally cylindrical wall portion 232 which depends from the underside of the top wall 228, and forms a chamber, within which the dispensing end of the nipple resides when the accessing member is in the retracted position, as depicted in FIG. 22. The diameter of the cylindrical wall at 232 is sized so that the generally spherical end portion of the nipple 112 tightly engages the internal surface of the chamber so as to better seal and protect the dispensing orifice 226 of the nipple. Of course, further means may be added to protect and seal the nipple from contamination, such as a shrink band or the like overlapping the cover and the container.

Figure 24:
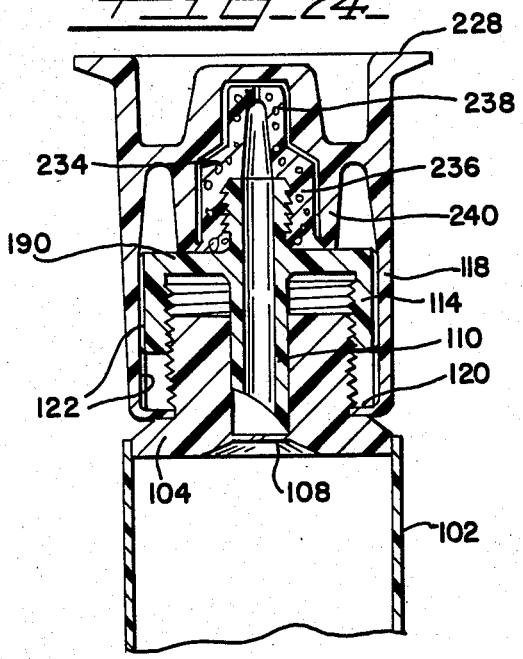
FIG. 24 shows an alternative embodiment of the nipple assembly and container of FIG. 22, employing a foam nipple and a modified cover construction.

The embodiment of the present invention depicted in FIG. 24 is essentially the same as that shown in FIG. 22, except that the nipple 234 employed in the embodiment in FIG. 24 is of foam construction, and includes areas of different densities for different purposes. As was described earlier in connection with FIGS. 18 and 19, the foam nipple as depicted in FIG. 24, has a generally cylindrical side wall portion 236, and a flexible dispensing end portion 238. The base and at least a portion of the side walls are sufficiently dense so as not to permit liquid passage therethrough. The density of the dispensing end, however, is sufficiently porous to allow liquid to pass through the sponge to a suckling infant.

In connection with this embodiment, the cover 116 includes means defining an internal chamber for receiving the nipple in a generally sealed relationship within the cover to prevent inadvertant contaminaton thereof. More particularly, the cover has a generally interior cylindrical wall portion 240 which is closed at the top and open at the bottom to receive the nipple. The cylindrical wall portion is sized to tightly engage and seal against the base portion of the nipple and the top wall 190 of the accessing member, when the nipple is in a retracted position, as shown in FIG. 24.

In the embodiment of FIG. 24, as well as those of FIGS. 22 and 23, the closed end of the cover provides a generally flat surface to permit stacking of the containers in an inverted position for packaging, storing and or the like.

Although the present invention has been described in terms of the illustrated embodiments, the scope of this invention, as defined in the appended claims, is intended to include those equivalent structures which may be apparent to persons of ordinary skill in the art.

What is claimed is:

1. An infant nurser comprising:

means defining a flexible plastic container having a penetrable wall portion;

a quantity of liquid within said container; and a nipple assembly carried by said container adjacent said penetrable wall portion, said nipple assembly including:

a hollow flexible dispensing nipple including a base portion carried by the container and a flexible nipple portion;

accessing means associated with said nipple, said accessing means being axially movable upon lateral compression of the flexible nipple portion to penetrable said penetrable wall portion to permit dispensing of said liquid through said nipple; and a cover enclosing said flexible nipple, said cover being axially substantially rigid and including means for lateral compression.

2. An infant nurser in accordance with claim 1 wherein said accessing means is disposed at least in part within said flexible nipple portion, said accessing means being movable by lateral compression of said flexible nipple portion to extend extend beyond said base portion to access said liquid.

3. An infant nurser in accordance with claim 1 wherein said accessing means includes means defining a rupturing surface for penetrating said penetrable wall portion.

4. A nipple assembly comprising:

a base portion adapted for attachment to a sealed liquid container;

a substantially hollow flexible nipple portion carried by said base portion, and having at least one dispensing aperture in the end thereof;

means for accessing the container contents, said accessing means being generally spherically shaped and disposed at least in part within said nipple portion and being axially movable upon lateral compression of said nipple portion to an accessing position where at one end of said accessing means extends beyond said base portion for rupturing a container wall to provide access to the contents thereof; and a cover enclosing said flexible nipple, said cover being axially substantially rigid and including means for lateral compression.

5. A nipple assembly in accordance with claim 4 further comprising means defining a detent between said accessing means and selected of said nipple portion and said base portion to retain said accessing means in said accessing position.

6. A nipple assembly in accordance with claim 4 wherein said cover including means to permit lateral compression of said nipple portion without direct tactile contact with said nipple portion.

7. A nipple assembly in accordance with claim 4 wherein said cover includes a substantially axial wall portion enclosing said nipple portion, said wall portion defining a plurality of axial ribs to provide substantial rigidity in the axial direction.

8. A nipple assembly in accordance with claim 6 wherein said cover includes an axial wall portion that comprises a plurality of axially extending scallop portions to provide substantial axial rigidity.

9. A nipple assembly comprising:

a base portion adapted for attachment to a sealed liquid container;

a hollow flexible nipple portion carried by said base portion and terminating in a dispensing end;

means disposed within said flexible nipple portion for accessing the contents of a container;

said accessing means comprising a generally spherically shaped member disposed within said flexible nipple portion intermediate said dispensing end of said nipple portion and said base portion, said member being movable upon lateral compression of said flexible nipple portion to extend beyond said base portion for rupturing the wall of a container to which the nipple is attached to permit dispensing of the contents thereof through said nipple portion; and a cover disposed over the flexible nipple portion, the cover including lateral compressible means to permit accessing the contents of the container without direct contact with the flexible nipple portion, the cover being substantially rigid in the axial direction.

10. A nipple assembly in accordance with claim 9 wherein said flexible nipple portion further comprises means defining an interior shoulder for retaining said spherical member in said intermediate position said shoulder being resilient to permit temporary enlargement for axial movement of said spherical member upon lateral compression of said flexible nipple portion.

11. A nipple assembly in accordance with claim 9 further comprising means defining a bellows portion in said flexible nipple portion, said bellows portion being located substantially outwardly of said spherical member.

12. A nipple assembly in accordance with claim 9 wherein said spherical member has a specific gravity less than 1.0.

13. A nipple assembly in accordance with claim 9 wherein said flexible nipple portion further comprises a tapered side wall portion disposed to engage said spherical member upon lateral compression of said side wall portion to force said spherical member axially to said accessing position.

14. A nipple assembly in accordance with claim 9 wherein said cover including hollow axially extending portion enclosing said flexible nipple portion, said axially extending portion defining a plurality of axially extending ribs to provide axial rigidity.

15. A nipple assembly in accordance with claim 14 wherein said axially extending portion includes a plurality of scalloped portions defining said rib between adjacent scalloped portion.

* * * * *

UNITED STATES PATENT AND TRADEMARK OFFICE

CERTIFICATE OF CORRECTION

PATENT NO. : 4,640,424

DATED : February 3, 1987

INVENTOR(S) : Leonard A. White

It is certified that error appears in the above–identified patent and that said Letters Patent are hereby corrected as shown below:

Column 13, lines 41-42:

Change [to penetrable said] to -- to penetrate said--.

Column 13, line 51:

Delete the second "extend".

Signed and Sealed this

Fifteenth Day of December, 1987

*Attest:*

DONALD J. QUIGG

*Attesting Officer*

*Commissioner of Patents and Trademarks*